US006966403B1

(12) United States Patent
Chandra

(10) Patent No.: US 6,966,403 B1
(45) Date of Patent: Nov. 22, 2005

(54) SMART LADDER

(76) Inventor: Suresh Chandra, 176 Debs Dr., Beavercreek, OH (US) 45434-6206

( * ) Notice: Subject to any disclaimer, the term of this patent is extended or adjusted under 35 U.S.C. 154(b) by 0 days.

(21) Appl. No.: 10/774,736

(22) Filed: Feb. 9, 2004

Related U.S. Application Data

(60) Provisional application No. 60/446,214, filed on Feb. 10, 2003.

(51) Int. Cl.[7] ..... E06C 5/34; E04G 1/00
(52) U.S. Cl. ..... 182/18; 182/129
(58) Field of Search ..... 182/18, 129, 94; 340/666, 665, 323 R

(56) References Cited

U.S. PATENT DOCUMENTS 3,965,464 A 6/1976 Kozai
4,311,208 A 1/1982 Macrorie et al.
4,554,994 A 11/1985 Weiner
5,027,923 A 7/1991 Derome
5,193,129 A * 3/1993 Kramer ..... 385/13
5,337,858 A 8/1994 Neubauer et al.
5,740,881 A 4/1998 Lensak
5,853,065 A * 12/1998 Hutson et al. ..... 182/18
5,954,154 A * 9/1999 Ziolkowski ..... 182/18
5,971,102 A * 10/1999 Brown ..... 182/129
6,374,947 B1 4/2002 Nurkiewicz
6,578,663 B2 * 6/2003 Schmitt et al. ..... 182/18
6,657,547 B2 * 12/2003 Ching-Yao ..... 340/666

* cited by examiner

*Primary Examiner*—Hugh B. Thompson, II
(74) *Attorney, Agent, or Firm*—Dinsmore & Shohl LLP

(57) ABSTRACT

A ladder with a tip warning system. The ladder is configured to be carried by at least one human user, and includes a plurality of legs with rungs disposed between the legs, and a tip warning system. The tip warning system includes an audio alarm and a visual alarm, a power source, one or more weight sensors and a controller signally coupled to the weight sensors. Imbalance conditions, such as due to the weight of a climber extending beyond the footprint of the ladder, generate an imbalance signal that activates the tip warning system to provide notorious indicia of such condition to the user. In one form, a counterweight activated by the imbalance signal may be incorporated to correct dangerous operating conditions.

32 Claims, 6 Drawing Sheets

Logic G = A; Y = B*(notA); R = notB

SMART LADDER

This application claims the benefit of U.S. Provisional Application No. 60/446,214 filed Feb. 10, 2003.

BACKGROUND OF THE INVENTION

This invention relates generally to ladders that incorporate safety features, and more particularly to ladders that provide warnings to a user that the ladder is about to tip.

Conventional household ladders (including step ladders and extension ladders) have enjoyed near universal acceptance by combining their ability to facilitate reaching remote areas with portable, human-carryable packaging. Nevertheless, conventional household ladders tip over when the combined center of gravity of a user (i.e., climber) and the ladder moves to a point beyond the foot of the ladder. In such a case a moment is produced, and while the frictional force of the wall tends to counter the torque caused by the moment, often it is not enough to prevent the ladder from tipping. Unbalance leading to ladder tipping typically occurs in one of two ways. In the first, the climber leans over too far to one side such that the center of gravity is beyond the ladder footprint. In the second, the ladder is placed leaning to one side, such as due to being placed on an uneven surface. In this latter case, the vertical line from the center of gravity of the ladder may not initially be beyond a foot of the ladder; however, as the climber moves higher up the ladder, the combined center of gravity of the ladder and the climber moves outside the ladder feet. Even though the imbalance leading to tipping of a ladder develops only gradually in this second instance, the climber remains unaware of the hazard until it is too late and the ladder tips over.

Accordingly, there exists a need for improvements in ladder design to enhance ladder safety, especially as it relates to ladder tipping. Moreover, there exists a need for notorious warnings that can alert a ladder user that a dangerous operating condition is imminent. Furthermore, there exists a need for a ladder that can deploy additional stabilizing members in response to dangerous ladder operating conditions. In addition, there exists a need for such a ladder that provides the above while being inexpensive and without sacrificing its human-carryable attributes.

SUMMARY OF THE INVENTION

These needs are met by the present invention. According to a first aspect of the present invention, a ladder configured to be carried by at least one human user is disclosed. The ladder includes a plurality of legs and rungs, one or more weight sensors coupled to at least one of the plurality of legs or rungs, a controller signally coupled to the one or more sensors a tip warning system and a power source to energize at least the tip warning system. The tip warning system is responsive to the controller such that upon attainment of a predetermined signal threshold, at least one of an audio or visual alarm provides notorious indicia to the user.

Optionally, the ladder is configured such that the one or more weight sensors are disposed adjacent the first end. Furthermore, the one or more weight sensors are disposed beneath the first end such that when the first end is placed upon a ladder-supporting surface, the sensor (or sensors) can measure a weight imposed by the ladder (when no one is standing on it) or by the combined weight of the ladder and a user standing on the ladder. In one form, the predetermined signal threshold can be a sensed weight that falls below a predetermined minimum. For example, if the signal threshold is set such that a sensed weight reading of close to zero (or some other predetermined number) registers with the controller (which would indicate that the weight sensor in question is detecting a significantly reduced load corresponding to the predetermined number), then the tip warning system would activate to alert the user of the unstable condition. In another form, a plurality of weight sensors can be deployed on the ladder so that the predetermined signal threshold could either be the predetermined minimum weight reading as discussed above, or another parameter such as the difference or ratio between the plurality of weight sensors, where the difference exceeds a predetermined maximum. In this configuration, it is a weight differential (either in the form of a simple difference or a ratio of readings from the disparate sensors) that is the triggering signal rather than the absolute value of the single weight sensor configuration above. This could be used, for example, in conjunction with laterally-spaced weight sensors so that the onset of a side-to-side imbalance could be sensed prior to such an imbalance becoming dangerous. The controller can be analog-based, utilizing comparator integrated circuits, or digital-based, using analog to digital (A/D) converters and a microprocessor.

The ladder may further include a movable counterbalancing weight responsive to the controller such that it deploys upon attainment of the predetermined signal threshold. At least one of the alarms can be disposed adjacent the second end. For example, where the alarm is a visual alarm (such as lights or a display, both discussed in more detail below), such an arrangement beneficially places the visual alarm relatively close to a user's eye such that early recognition of a potentially unsafe ladder operating condition is being approached. In yet another option, the power source can be a battery, solar cell or the like. Moreover, the ladder is preferably a household ladder, such as a stepladder or an extension ladder. As mentioned above, the visual alarm may be made up of one or more lights, where in the case of a plurality of lights, each of the plurality of lights corresponds to particular ladder safety category, such as a first safety category, a second safety category and a third safety category, or to a system operational status (for example, indicating whether the system is on or off). Similarly, the audio alarm can be one or more buzzers, a prerecorded verbal warning or the like. In the case of a buzzer, the alarm can be configured to emit tones of progressively higher frequency or volume as the ladder gets closer to an unstable, imbalanced position.

According to another aspect of the invention, a tip-sensing ladder is disclosed. The ladder includes a plurality of legs defined by a first end and a second end, a plurality of rungs disposed between the legs and a tip warning system. The system includes a plurality of weight sensors coupled to legs or rungs, a controller signally coupled to the weight sensors, a plurality of alarms comprising an audio alarm and a visual alarm, and a power source. The alarms are responsive to the controller such that upon attainment of a predetermined signal threshold in the controller, at least one of the alarms activates.

According to still another aspect of the invention, a method of using a ladder is disclosed. The method includes configuring a ladder similar to that of at least one of the previously-described aspects, placing the tip warning system in an operational condition, placing the ladder against a ladder engaging surface, climbing the ladder such that indicia is provided to a climber thereof to indicate at least one of an operational status or a ladder safety category.

Optionally, the ladder safety category comprises at least two first ladder safety categories, where the first is indicative of no imminent tipping, while a second is indicative of a possible tipping condition.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION OF THE PREFERRED EMBODIMENTS

Figure 1:
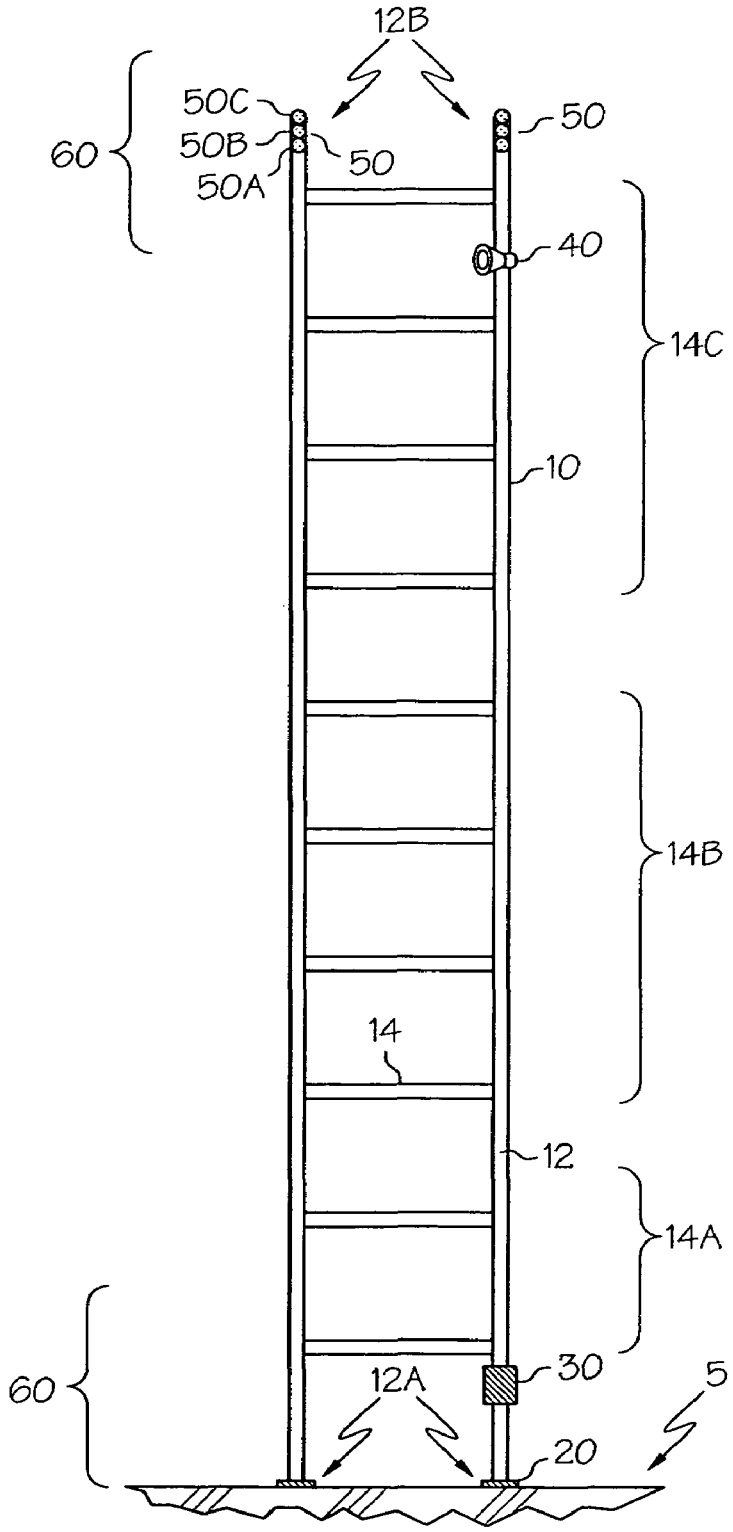
FIG. 1 illustrates a ladder according to an embodiment of the present invention.
Figure 3A:
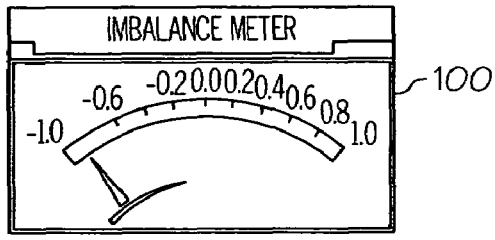
FIG. 3A illustrates one form of visual display used to indicate the level of imbalance.
Figure 3B:
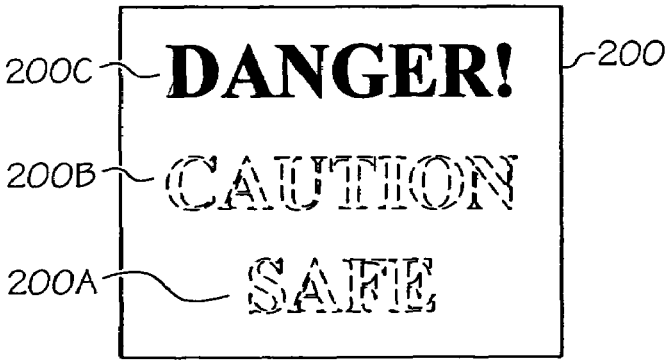
FIG. 3B illustrates another form of visual display used to project a warning sign.

Referring initially to FIGS. 1, 3A and 3B, a ladder 10 according to an embodiment of the present invention is shown placed on a ladder-engaging surface 5 (such as a floor, the ground or the like). Ladder 10 includes a pair of legs 12 each defined by a first end 12A positioned on ladder-engaging surface 5, and second end 12B opposite first end 12A, and a plurality of rungs 14 that connect the legs 12 together. It will be appreciated by those skilled in the art that while the embodiment depicted in the figure is a fixed household ladder, the present invention is equally suitable to extension ladders, step ladders, folding ladders or the like. In the present context, the phrase "household ladder" is not meant to limit applicability to ladders used in private, residential settings. As such, the phrase is understood to include commercial and non-residential variants, so long as the ladder is portable by being human-carryable, such as those that can be carried by an individual. Ladders that generally do not qualify as "household" or "human-carryable" are those that form an integral part of a larger structure, such as a ladder that is permanently or semi-permanently secured to a fire-engine or related safety vehicle.

Ladder 10 includes weight sensors 20, controller 30 and one or more audio alarms 40 and visual alarms 50, where visual alarm 50 is shown in one form as a series of lights 50A, 50B, 50C. Visual alarm 50 can be made up of a series of lights, where the lights are color-coded. For example, a green light 50A can indicate a first ladder safety category, while a yellow light 50B can indicate a second ladder safety category (possibly coinciding with a condition requiring caution), and a red light 50C to indicate a third ladder safety category (possibly coinciding with a dangerous operating condition with a significant amount of imbalance). Together, weight sensors 20, controller 30 and alarms 40 and 50 make up tip warning system 60, where tip warning system 60 can give the ladder "smart" features such that it can sense and convey to the user indicia of an impending dangerous operating condition faster than the user can.

Referring with particularity to FIGS. 3A and 3B, two variations on an alternate embodiment of the visual alarm is shown, where in the first variation of FIG. 3A, a meter 100 registers the degree of imbalance, while in a second variation of FIG. 3B, a warning display 200 responds to controller 30 by highlighting various words dependent upon the ladder safety category (also known as the imbalance status), where the aforementioned first ladder safety condition is accompanied by a green color display 200A of the word SAFE, a moderate amount of imbalance (commensurate with the aforementioned second ladder safety condition) is indicated by a yellow display 200B of the word CAUTION, and a hazardous condition (equivalent to the aforementioned third ladder safety condition) indicated by a red display 200C of the exclamation DANGER! as shown. Also as previously discussed, the hazardous condition could also be accompanied by an audible warning from audio alarm 40.

Referring with particularity to FIG. 1, weight sensors 20 are placed at the bottom of each leg 12. In a preferable form, the weight sensors 20 are of lightweight construction such that they do not appreciably add to the overall weight of ladder 10. In one form, the sensors 20 are of the laminated thin-film variety, where the electrical conductance is substantially proportional to the applied force or weight upon them. In the present context, the term "substantially" is utilized to represent the inherent degree of uncertainty that may be attributed to any quantitative comparison, value, measurement, or other representation. As such, it refers to an arrangement of elements or features that, while in theory would be expected to exhibit exact correspondence or behavior, may in practice embody something slightly less than exact. The term also represents the degree by which a quantitative representation may vary from a stated reference without resulting in a change in the basic function of the subject matter at issue. Although shown with two weight sensors 20, it is also within the scope of the present invention to configure the ladder 10 with a single weight sensor 20, mounted at or near the first end 12A of one of the legs 12. As previously discussed, the sensors 20 can either be coupled so that they send a difference or ratio signal to controller 30, or they can be independent, where each can respond to a predetermined weight threshold stored in the memory of controller 30. For example, the stored threshold may be an equivalent to an absolute force value, such as something at or near zero pounds force, zero being the condition prerequisite on one of its legs 12 for ladder 10 tipping. By using weight sensors 20 rather than a conventional pendulum-based indicator, the present invention allows a more accurate reading to be taken, as the weight sensor (or sensors) 20 can account for user-generated moments that a pendulum-based or switch-based device would not be sensitive to. This additional sensitivity is possible because the tip warning system 60 of the present invention can discriminate against user weight on the lower rungs 14A, as such condition is not as likely to produce a tipping condition as that when the user is on the middle or upper rungs 14B, 14C. By contrast, a pendulum-based or switch-based device is responsive only to the angle the switch or pendulum registers relative to a predetermined axis.

Figure 2:
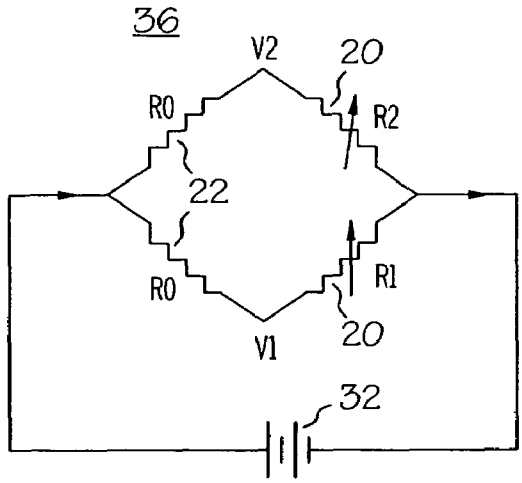
FIG. 2 illustrates a Wheatstone bridge circuit incorporating weight sensors R1 and R2.

Referring next to FIG. 2, a Wheatstone (or resistance) bridge type electrical circuit 36 was formed incorporating two weight sensors 20 that demonstrate variable resistance $R_1$ and $R_2$ and two fixed resistors 22 that demonstrate substantially fixed resistance $R_0$, where the imbalance between the sensor voltages provided a measure of the weight imbalance at the legs 12. As mentioned in the previous paragraph, weights measured by the sensors 20 can be used to send a weight difference or a weight ratio to the controller 30. For example, the measure of imbalance between the two weight sensors 20 can be given by the simple ratio of (W1−W2)/(W1+W2), where W1 and W2 represent the measured weight at each of the sensors 20, respectively. In such circumstance, it will be readily appreciated that the range of imbalance is normalized between −1 and 1, thereby removing the need for calculating actual weight values and making the range of imbalance applicable for climbers of various weights. A zero reading means an exact balance (W1=W2) between the two sensors 20, and an imbalance measure of ±1 means instability resulting from either of the two sensors 20 registering a weight value that approaches zero. Thresholds for the aforementioned heightened alert displays 200B and 200C can be set by a choice of the values for the imbalance measure.

Battery 32 (for example, a conventional nine-volt battery) provides power to controller 30, although it will be appreciated that other power sources could be employed, including, for example, solar cells or related photovoltaic devices. When equal weight is applied to both sensors 20, $R_1$ will equal $R_2$ and the corresponding output voltages $V_1$ and $V_2$ will be equal. Contrarily, a weight imbalance on ladder 10 shows up as a difference between $V_1$ and $V_2$. In the simplest system, output voltages $V_1$ and $V_2$ could be wired directly to meter 100, as shown in FIG. 3A. In a preferred (but by no means necessary) system, the output voltages $V_1$ and $V_2$ will be further processed by either digital or analog electronics in controller 30 to provide a more reliable warning system. In one preferred embodiment, voltages $V_1$ and $V_2$ will be read by controller 30 that would include an analog-to-digital (A/D) converter and a microprocessor (not shown). The microprocessor will control the tip warning system 60 according to a program stored into its memory where, as previously discussed, the tip warning system 60 may include one or more of the aforementioned alarms, such as the lights 50, meter 100, display 200, audio system 40 or some combination thereof. The measured values from the weight sensors 20 are then used to calculate the imbalance according to an algorithm and compared to a predetermined threshold. If controller 30 detects imbalance beyond the predetermined threshold, at least one of the audio and visual alarms 40, 50 are activated to alert the user. Tip warning system 60 can be programmed such that the companion audio alarm 40 responds either progressively (with, for example, a loudness or frequency level that increases concomitant to the aforementioned ladder safety category) or selectively (for example, not until a predetermined threshold). The indicia enabled by audio alarm 40 is beneficial in that a ladder user need not constantly maintain line-of-sight contact with a visual alarm to be apprised of a potentially dangerous ladder 10 operating condition. The two separate forms of indicia made possible by combining audio and video alarms 40, 50 further improves the chances that a user will be alerted that a potentially dangerous ladder operating condition has been, or is about to be, reached. Operational status of tip warning system 60 could be ensured by including a confirmation signal, such as a simple, slow-period (i.e., low frequency) beep from the audio alarm 40 or a slow-period flash of light from the visual alarm 50.

Figure 4:
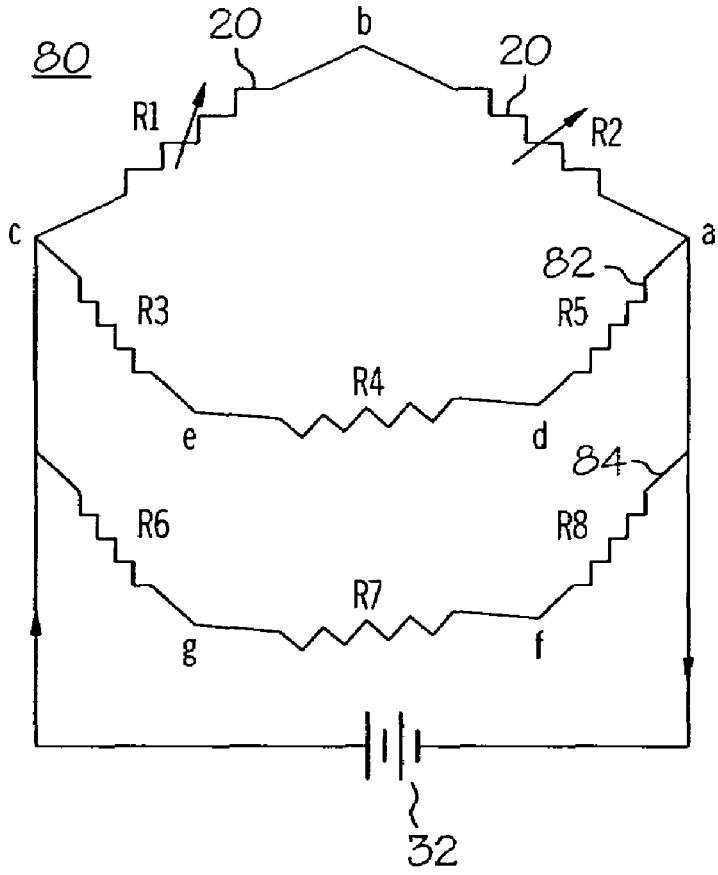
FIG. 4 illustrates a modified Wheatstone bridge circuit incorporating the weight sensors R1 and R2.
Figure 5:
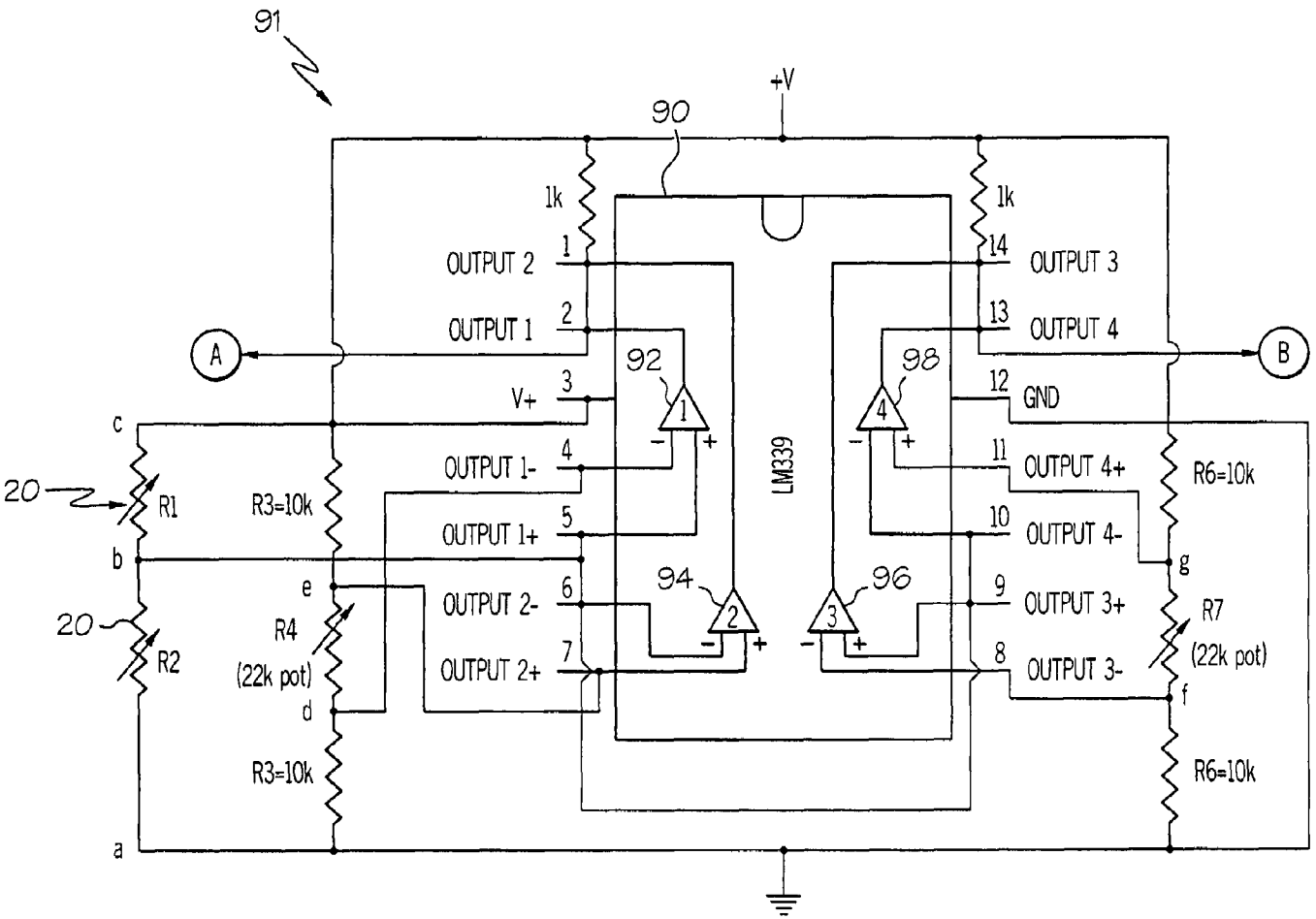
FIG. 5 illustrates the circuit of FIG. 4 integrated with a quad comparator to sense ladder imbalance.
Figure 6:
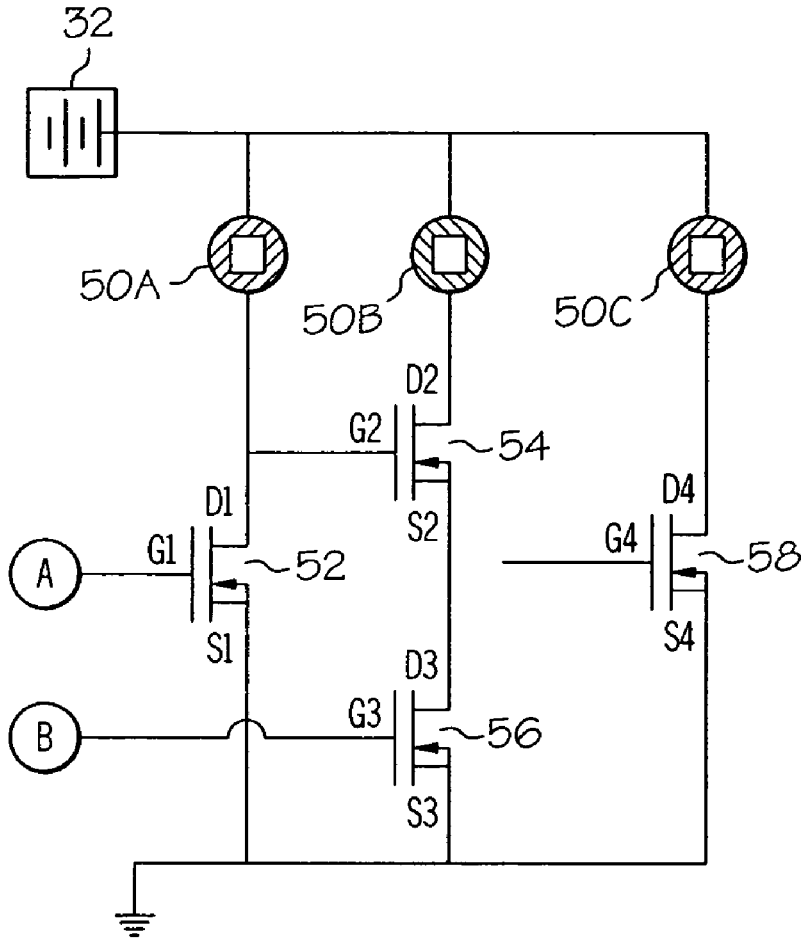
FIG. 6 illustrates MOSFET logic using input from the comparator of FIG. 5 to control a plurality of colored lights and buzzers.

Referring next to FIGS. 4 through 6, an approach to sensing and alerting a user as to the presence of a ladder imbalance is shown. Referring with particularity to FIG. 4, a modified Wheatstone bridge 80 incorporating the weight sensing resistors 20 (again capable of registering variable resistance $R_1$ and $R_2$) is shown. FIG. 5 shows how the various connections a, b, c, d, e, f and g of the Wheatstone bridge 80 of FIG. 4 are integrated with a quad comparator 90 to provide the imbalance triggers that are then fed into the controller 30 logic circuit shown in FIG. 6. While one way to operate the tip warning system 60 is to monitor in real time the weight on each leg 12 such that one or both of the alarms 40, 50 are activated whenever the sensed weight on either leg 12 falls below preset limits, it is more reliable and more independent of the user's weight to implement tip warning system 60 in the manner described next.

The construction of modified Wheatstone bridge 80 is such that two voltage divider chains 82, 84 comprise three resistors each. The first chain 82 includes resistors R3, R4 and R5 while the second 84 includes resistors R6, R7 and R8. In one implementation, the resistors R3, R5, R6 and R8 are 10 kilo-ohms each, while resistors R4 and R7 are each a 22 kilo-ohms adjustable potentiometers. The resistor junctions d, e, f and g provide convenient reference voltages for comparator 90 to analyze the voltage appearing at the junction b between the weight sensors 20 (with the aforementioned variable resistances $R_1$ and $R_2$, respectively). As shown in FIG. 5, the four comparator circuits 92, 94, 96 and 98 within comparator 90 were set up to compare the voltage appearing at junction b with that at junctions d, e, f and g, respectively. Circuit 91 is arranged with two pairs of comparators that are wired such that switch signals occur at points A and B at certain levels of ladder imbalance as the values measured by weight sensors 20 vary. The variable resistors R4 and R7 can be adjusted to select the levels of imbalance between weight sensors 20 at which A and B switch to a low voltage reading. By choosing resistor R7 to be greater than resistor R4, point A is ensured to switch from a high voltage to a low voltage before point B does. Initially, with weight sensors 20 being comparable in value, the output voltage at points A and B are both high. Analysis shows that point A stays high as long as (R3/(R4+R5))<(R1/R2)<((R4+R3)R5) and switch to the low state outside this range (where R1 corresponds to the weight sensor 20 located between points b and c in FIG. 4 and R2 corresponds to the weight sensor 20 located between points a and b). With resistor R3 chosen equal to resistor R5 for symmetric switching, the magnitude of resistor R4 determines the point at which point A would switch. The larger the value of resistor R4, the greater the imbalance between R1 and R2 required for the switch to occur. As an example, if R3=R5=R6=R8 and R4 is twice the value of R3, and R7 is three times the value of R3, then point A would stay high for a ratio of R1 to R2 (or R2 to R1, depending on which of the weight sensors 20 registers the larger load) less than three, and would switch to low when the ratio becomes greater than three. Similarly, point B will switch from high to low when the ratio of R1 to R2 (or R2 to R1 for the reason mentioned above) is greater than four. The switching of points A and B can be exploited to activate the audio alarm 40 and the lights 50A, 50B, 50C or displays 100, 200, shown and described previously when a state of imbalance is approached or achieved.

Referring with particularity to FIG. 6, specific implementation of the embodiment of tip warning system 60 employing the series of lights 50A, SOB, 50C is shown. The simplest logic implementation was achieved using four MOSFETs 52, 54, 56 and 58 as shown. The output from point A is connected to the gate of MOSFET 52 while point B is connected to the gate of MOSFET 56. With points A and B registering high voltages, only the green light 50A is turned on. When point A switched to a low voltage, the yellow light 50B comes on while green light 50A is turned off. With point B also switching to a low voltage (while point A stays low), the red light 50C is turned on while yellow light 50B is turned off. Audio alarm 40 connected in parallel with the lights 50A, 50B, 50C can provide audio warnings. As previously mentioned, different sounds (or even different audio alarms 40) can be used to give a user a distinguishable audible warning depending on the severity of the imbalance, where variations in tone, volume or any other easily-perceivable quantity can be utilized. In the case of tone variation, the audio alarm 40 can emit a slow beep or, alternatively, a low frequency signal for a first ladder safety condition, with progressively higher frequency signals for the second and third ladder safety conditions.

Figure 7:
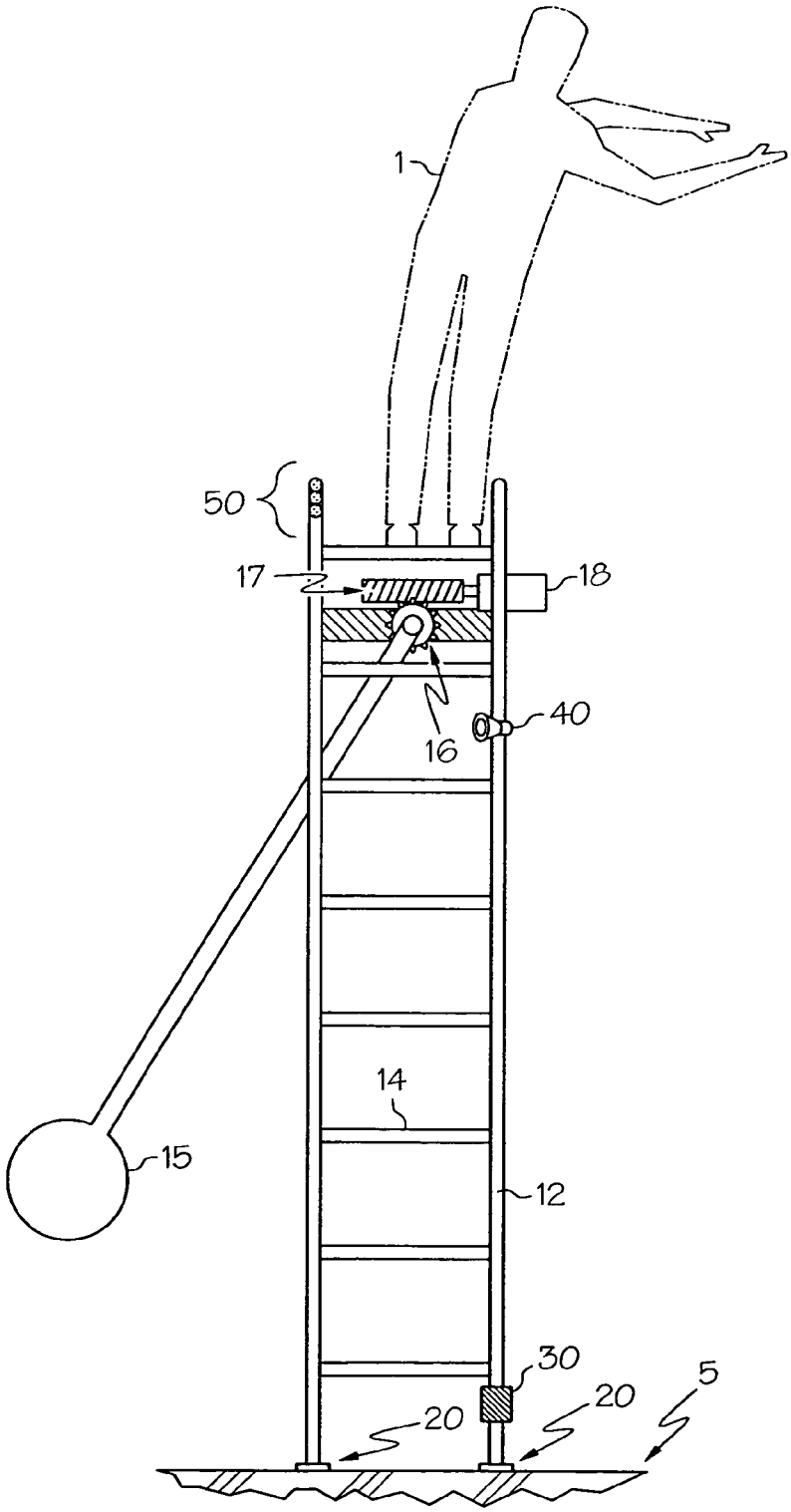
FIG. 7 illustrates an optional counterbalance weight attached to the ladder of FIG. 1.

The attributes of tip warning system 60 hitherto described are of a passive nature; while the system 60 senses force values and reports possible ladder imbalance conditions, it does nothing to correct a potentially dangerous situation. Referring next to FIG. 7, ladder 10 may incorporate active tip-prevention features that utilize the imbalance information generated in the tip warning system 60 by deploying one or more members that are attached to the ladder 10. In one form, the tip-prevention member is made up of one or more deployable counterbalancing weights 15. These weights 15 can be released upon appropriate signal from controller 30 to motor 18 that drives a screw 17 that turns gear 16 to which weight 15 is attached. When user 1 leans too far to one lateral side of ladder 10, sensors 20 detect the weight shift, causing controller 30 to activate motor 18, screw 17, gear 16, which in turn causes deployment of counterbalancing weight 15 to the opposing lateral side of ladder 10. In other configurations, the weight 15 could be spring-loaded or even manually adjustable.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A ladder configured to be carried by at least one human user, said ladder comprising:

a plurality of legs, each defined by a first end and a second end;

a plurality of rungs disposed between said legs; and a tip warning system comprising:

at least one of an audio alarm or a visual alarm;

a power source to energize said at least one alarm;

a plurality of weight sensors, each cooperative with a corresponding one of said plurality of legs or rungs; and a controller signally coupled to said weight sensors such that upon generation of a weight signal in each of said weight sensors, said controller compares differences in said signals to determine a measure of imbalance in said ladder and provide, upon attainment of a measure of said imbalance that exceeds a predetermined signal threshold, notorious indicia to said human user through said at least one alarm.

2. The ladder of claim 1, wherein said plurality of weight sensors are disposed adjacent said first end.

3. The ladder of claim 2, wherein said plurality of weight sensors are disposed beneath said first end.

4. The ladder of claim 1, wherein said measure of imbalance comprises a ratio of said differences in said sensed weight signals divided by a sum of said sensed weight signals.

5. The ladder of claim 1, wherein said controller comprises analog comparators.

6. The ladder of claim 1, wherein said controller comprises at least one digital microprocessor.

7. The ladder of claim 1, further comprising a movable counterbalancing weight coupled to said ladder, said counterbalancing weight responsive to said controller.

8. The ladder of claim 7, wherein said counterbalancing weight is mechanically adjustable.

9. The ladder of claim 7, wherein said counterbalancing weight is manually adjustable.

10. The ladder of claim 1, wherein said power source comprises a battery.

11. The ladder of claim 1, wherein said power source comprises a solar cell.

12. The ladder of claim 1, wherein said ladder is a stepladder.

13. The ladder of claim 1, wherein said at least one alarm comprises said audio alarm and said visual alarm.

14. The ladder of claim 13, wherein at least one of said alarms is disposed adjacent said second end.

15. The ladder of claim 14, wherein said visual alarm comprises at least one light.

16. The ladder of claim 15, wherein said at least one light comprises a plurality of lights.

17. The ladder of claim 16, wherein each of said plurality of lights corresponds to particular ladder safety category.

18. The ladder of claim 17, wherein said plurality of lights comprise:

a first light to indicate at least one of system operational status or a first of said ladder safety category;

a second light to indicate a second of said ladder safety category; and a third light to indicate a third of said ladder safety category.

19. The ladder of claim 14, wherein said visual alarm comprises at least one display.

20. The ladder of claim 1, wherein said at least one alarm comprises said audio alarm.

21. The ladder of claim 20, wherein said audio alarm comprises a buzzer.

22. The ladder of claim 20, wherein said audio alarm is configured to vary an acoustic output that corresponds to particular ladder safety category.

23. The ladder of claim 22, wherein said varied acoustic output comprises:

a first sound to indicate at least one of system operational status or a first of said ladder safety category;

a second sound to indicate a second of said ladder safety category; and a third sound to indicate a third of said ladder safety category.

24. The ladder of claim 23, wherein said first, second and third sounds comprise tones of successively higher frequency, respectively.

25. The ladder of claim 20, wherein said audio alarm comprises a prerecorded voice warning.

26. The ladder of claim 1, wherein said plurality of legs comprises no more than two legs.

27. The ladder of claim 1, wherein said ladder is an extension ladder.

28. A method of using a ladder, said method comprising:

configuring a ladder to comprise:

a plurality of legs;

a plurality of rungs disposed between said legs; and a tip warning system comprising:

an audio alarm and a visual alarm;

a power source to energize at least said audio and visual alarms;

a plurality of weight sensors, each coupled to a respective one of said plurality of legs or rungs; and a controller signally coupled to said weight sensors such that upon attainment of a predetermined signal threshold based on a difference in measured signals from said weight sensors, said tip warning system provides notorious indicia to a climber through at least one of said alarms;

placing said tip warning system in an operational condition;

placing said ladder against a ladder engaging surface;

climbing said ladder such that indicia is provided to said climber thereof to indicate at least one of an operational status or a ladder safety category, said ladder safety category comprising at least a first ladder safety category indicative of no imminent tipping and a second ladder safety category indicative of a possible tipping condition.

29. The method of claim 28, wherein said plurality of weight sensors are, each cooperative with a corresponding one of said plurality of legs or rungs such that upon generation of a weight signal in each of said weight sensors, said controller compares differences in said signals to determine a measure of imbalance in said ladder and provide, upon attainment of a measure of said imbalance that exceeds said predetermined signal threshold, said notorious indicia.

30. The method of claim 29, wherein said measure of imbalance comprises calculating a ratio of said sensed weight signal differences divided by a sensed weight sum.

31. The method of claim 28, wherein said plurality of legs comprises no more than two legs.

32. A tip-sensing ladder comprising:

a plurality of legs defined by a first end and a second end;

a plurality of rungs disposed between said legs to define a climbing path between said first and second ends; and a tip warning system, said system comprising:

a plurality of weight sensors, each cooperative with a corresponding one of said plurality of legs or rungs;

a controller signally coupled to said weight sensors;

a plurality of alarms comprising an audio alarm and a visual alarm, said alarms responsive to said controller such that upon generation of a weight signal in each of said weight sensors, said controller compares differences in said signals to determine a measure of imbalance in said ladder and provide, upon attainment of a measure of said imbalance that exceeds a predetermined signal threshold, notorious indicia to a user through said at least one alarm; and a power source to energize at least said plurality of alarms.

* * * * *

UNITED STATES PATENT AND TRADEMARK OFFICE

CERTIFICATE OF CORRECTION

PATENT NO. : 6,966,403 B1
APPLICATION NO. : 10/774736
DATED : November 22, 2005
INVENTOR(S) : Suresh Chandra It is certified that error appears in the above-identified patent and that said Letters Patent is hereby corrected as shown below:

Col. 8, line 32 “14” should read --13--

Col. 8, line 46 “14” should read --13--

Signed and Sealed this

Twenty-second Day of August, 2006

JON W. DUDAS
*Director of the United States Patent and Trademark Office*